US011859383B2

(12) United States Patent
Nilsson

(10) Patent No.: US 11,859,383 B2
(45) Date of Patent: Jan. 2, 2024

(54) SUSPENDED CEILING SYSTEM AND METHOD FOR INSTALLING THEREOF

(71) Applicant: SAINT-GOBAIN ECOPHON AB, Hyllinge (SE)

(72) Inventor: Thomas Nilsson, Helsingborg (SE)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 0 days.

(21) Appl. No.: 17/783,110

(22) PCT Filed: Dec. 8, 2020

(86) PCT No.: PCT/EP2020/084970
§ 371 (c)(1),
(2) Date: Jun. 7, 2022

(87) PCT Pub. No.: WO2021/122125
PCT Pub. Date: Jun. 24, 2021

(65) Prior Publication Data

US 2023/0015651 A1 Jan. 19, 2023

(30) Foreign Application Priority Data

Dec. 16, 2019 (EP) ..... 19216638

(51) Int. Cl.
*E04B 9/18* (2006.01)
*E04B 9/06* (2006.01)

(52) U.S. Cl.
CPC ..... *E04B 9/183* (2013.01); *E04B 9/061* (2013.01)

(58) Field of Classification Search
CPC . E04B 9/061; E04B 9/068; E04B 9/10; E04B 9/183
See application file for complete search history.

(56) References Cited

U.S. PATENT DOCUMENTS 3,599,921 A * 8/1971 Cumber ..... E04B 9/006 248/300
3,898,784 A * 8/1975 Sauer ..... E04B 9/10 403/364

(Continued)

FOREIGN PATENT DOCUMENTS

| | | |
|---|---|---|
| EP | 2 562 323 A1 | 2/2013 |
| JP | 51-12413 U | 1/1976 |
| WO | WO 2013/007690 A1 | 1/2013 |

OTHER PUBLICATIONS

International Search Report dated Mar. 12, 2021, in PCT/EP2020/084970 filed Dec. 8, 2020, 3 pages.

(Continued)

*Primary Examiner* — James M Ference
(74) *Attorney, Agent, or Firm* — Oblon, McClelland, Maier & Neustadt, L.L.P.

(57) ABSTRACT

A suspended ceiling system (1) comprising a plurality of ceiling tiles and a grid (100) of profiles (40) for supporting the plurality of ceiling tiles, the grid (100) of profiles (40) comprising at least a first and a second profile (40) configured to be interconnected along a longitudinal axis, the first and second profile (40) each comprising two laterally extending flanges (43) and an upstanding web (44) provided with a bulb (41) at its free end, wherein each of the first and second profile (40) has a curved extension and is configured to be installed such that it, in an installed and unloaded condition, bulges in an upward direction.

13 Claims, 4 Drawing Sheets

(56) References Cited

U.S. PATENT DOCUMENTS 3,998,020 A * 12/1976 Kuhr ..... E04B 9/18 52/506.07
4,189,893 A * 2/1980 Kuhr ..... E04B 9/28 52/506.07
4,723,749 A * 2/1988 Carraro ..... E04B 9/18 52/39
4,905,952 A * 3/1990 Pinquist ..... E04B 9/16 24/537
5,203,818 A * 4/1993 Kuiper ..... E04B 9/068 52/506.06
6,041,564 A * 3/2000 Shirey ..... B21D 39/034 29/21.1
6,305,139 B1 * 10/2001 Sauer ..... E04B 9/10 52/669
6,957,517 B2 * 10/2005 Auriemma ..... E04B 9/061 52/506.07
7,614,195 B2 * 11/2009 Platt ..... E04B 9/122 52/506.06
7,669,374 B2 * 3/2010 Miller ..... E04B 9/068 52/506.07
7,673,429 B2 * 3/2010 Frecska ..... F16B 7/048 52/506.07
7,770,349 B2 * 8/2010 Tedesco ..... E04B 9/122 52/506.07
7,832,168 B2 * 11/2010 Lehane, Jr. ..... E04B 9/068 52/506.07
8,336,843 B2 * 12/2012 Gulbrandsen ..... E04B 9/065 24/537
8,443,564 B2 * 5/2013 Bankston, Jr. ..... E04B 9/127 52/712
8,615,947 B2 * 12/2013 Underkofler ..... E04B 9/18 248/323
8,893,449 B1 * 11/2014 Underkofler ..... E04B 9/18 52/657
9,151,050 B2 * 10/2015 Santeramo ..... E04B 9/10
9,453,339 B2 9/2016 Baxter et al.
9,809,976 B2 * 11/2017 Sareyka ..... F16M 13/027
10,371,290 B2 * 8/2019 Dafonseca ..... F16B 2/18
2004/0111995 A1 * 6/2004 Dockery ..... E04B 9/205 52/506.08
2005/0034412 A1 * 2/2005 Auriemma ..... E04B 9/068 52/831
2007/0180787 A1 * 8/2007 Fecska ..... E04B 9/127 52/506.06
2008/0060306 A1 * 3/2008 Platt ..... E04B 9/064 52/506.06
2008/0155927 A1 * 7/2008 Wendt ..... E04B 9/28 52/506.07
2008/0245018 A1 * 10/2008 Miller ..... E04B 9/061 52/506.07
2010/0005747 A1 * 1/2010 Tedesco ..... E04B 9/122 52/506.08
2010/0252704 A1 * 10/2010 Kunishita ..... E04B 9/183 248/223.41
2013/0167465 A1 * 7/2013 Santeramo ..... E04B 9/10 52/506.07
2018/0135300 A1 * 5/2018 Czyzewicz ..... E04B 9/068
2023/0015651 A1 * 1/2023 Nilsson ..... E04B 9/183

OTHER PUBLICATIONS

Indian Office Action dated Jan. 23, 2023 in Indian Patent Application No. 202227028061, 6 pages.

* cited by examiner

SUSPENDED CEILING SYSTEM AND METHOD FOR INSTALLING THEREOF

FIELD OF THE INVENTION

The present invention relates to suspended ceiling systems comprising a plurality of ceiling tiles and a grid of profiles for supporting the plurality of ceiling tiles, the suspended ceiling system being adapted for instance for use in offices or public buildings etc. The invention further relates to a method for installing such a suspended ceiling system.

BACKGROUND ART

Suspended ceiling systems are used in many different types of buildings e.g. to lower the ceiling, to provide sound dampening, to facilitate mounting of light sources and other building equipment and to provide an aesthetically pleasing interior ceiling. Suspended ceiling systems, as the name implies, are attached to a supporting structure of some sort, such as the ceiling structure of the building. Suspended ceiling systems usually comprises a plurality of ceiling tiles and a supporting structure in form of a grid. The grid comprises profiles which support the ceiling tiles. The grid often comprises main profiles which are suspended to the ceiling structure of the building and transverse or cross profiles which are supported by the main profiles. The profiles usually have an inverted T-shape. The ceiling tiles may have sound-absorbing and/or sound-insulating properties in order to improve the acoustic environment of the room. In order to obtain a lightweight ceiling with satisfactory sound absorption, the tiles, for instance, may be made of a compressed fibre material such as mineral wool and especially glass wool. In addition to ceiling tiles, the profiles may also support various equipment such as lighting devices, ventilation equipment, inspection openings, detectors, cable trays, loudspeakers, signs, sprinklers etc.

The grid profiles are thus subjected to loads resulting from the weight of the profile itself along with the thereto attached tiles and equipment as described above. This causes deflection of the profiles, the deflection being proportional to the load subjected to the profile along with the span between the points where the profile is supported.

The deflection is measured as the distance between the profile and an imaginary straight line between adjacent suspension points when the profile is in its loaded condition.

Various standards for suspended ceilings, for example EN 13964 include requirements on the maximum deflection allowed. EN 13964 allows a deflection (for instance measured in mm) not exceeding the distance of the profile between the adjacent suspension points (for instance measured in mm) divided by 500 (for EN 13964 class 1), or for certain premises divided by 300 (EN 13964 class 2). However, the maximum deflection must be less or equal to 4,0 mm according to EN 13964 class 3.

To minimise the deflection and to increase the load which is exertable to a grid profile it is according to EP 2 562 323 A1 suggested to provide grid profiles which are upwardly curved. Such systems effeciently increases the amount of weight that the grid can carry without deviating from the deflection requirements described above.

The grid profiles are usually suspended from a supporting structure by means of some sort of suspension element such as a hanger. The hanger is connected to the grid usually through a hole in the profile. Each hanger is associated with a cost, not only for the hanger itself, but also in that it is relatively time consuming to fit. The presence of installations and/or building structures in the vicinity of the supporting structure may also cause problems, also referred to as clashing, when fitting the hangers. It is consequntly always desired to reduce the number of hangers along the extension of the profiles to improve the cost effeciency of the suspended ceiling. Naturally however, this causes problems in terms of keeping the deflection of the grid profiles within the boundaries defined above.

SUMMARY OF THE INVENTION

In view of that stated above, the object of the present invention is to provide a suspended ceiling system ameliorating some of the problems with prior art. It is also an object to provide a method for installing a suspended ceiling system which is an improvement of prior art methods.

To achieve at least one of the above objects and also other objects that will be evident from the following description, a suspended ceiling system having the features defined in claim 1 and a method for installing a suspended ceiling having the features defined in claim 13 are provided according to the present invention. Preferred embodiments of the suspended ceiling system will be evident from the dependent claims.

More specifically, there is provided in a first aspect according to the present invention a suspended ceiling system comprising a plurality of ceiling tiles and a grid of profiles for supporting the plurality of ceiling tiles. The grid of profiles comprising at least a first and a second profile configured to be interconnected along a longitudinal axis, the first and second profile each comprising two laterally extending flanges and an upstanding web provided with a bulb at its free end. Each of the first and second profile has a curved extension and is configured to be installed such that it, in an installed and unloaded condition, bulges in an upward direction.

The suspended ceiling system further comprises a connection element arranged for mounting over a portion of the bulbs of the first and second profile at a joint between the first and second profile and a suspension element connectable to the connection element for suspension of the first and second profile in their interconnected state.

The ceiling system is thus allowed to be suspended from the joints between the profiles, which allows full utilization of the span of the curved extension of the profile while reducing the number of suspension points necessary for the system. The connection element further enables alignment of the first and second profiles in the joint. The suspension of the ceiling system using both a connection element and a separate suspension element provides flexibility, as it, depending on the application, allows either the connection element to be mounted to the profiles first or the connection element and the suspension element mounted to each other before the connection element is mounted to the profile.

The connection element may be arranged for snap fit mounting over the portion of the bulbs of the first and second profile. The snap fit mounting makes the attachment of the mounting elements to the profiles effortless and rapid and removes the need for tools.

The connection element may comprise two resilient legs which for said snap fit mounting are configured to straddle and retain the portion of the bulbs of first and second profile. The connection element is thus held in place by its interaction with the bulbs on the profiles. The connection element will further contribute to keeping the first and second profile aligned and held together.

The connection element may further comprise a bridging section having a first side from which the two resilient legs extend; and a protruding section provided with an opening arranged on a second side, opposing the first side, of the bridging section. The suspension element is configured to connect to the connection element by means of said opening. With the opening arranged on a protruding section on a side opposite that of the legs, conveniently places the opening such that it can be easily reached for connection of the suspension element.

The connection element may further comprise a protruding section provided with an opening, the suspension element being configured to connect to the connection element by means of said opening. With the opening arranged on a protruding section, it can be easily reached for connection of the suspension element.

Further still, the suspension element may comprise a hook member, the opening of the protruding section being configured to receive the hook member for connection of the suspension element to the connection element.

The suspension element comprises a free end provided with an opening, wherein suspension element is connectable to the connection element by means of a fastener inserted into the openings of the suspension element and the protruding section when the openings are aligned with each other.

The connection element may be made of a sheet metal material, which provides a low cost per unit and rapid production while providing sufficiently strong connection element for carrying the weight of the ceiling system.

Each of the first and second profile may have a joint end being provided with a tongue arrangement, the tongue arrangements of the first and second profile are configured for interlocking engagement in the interconnected state of the first and second profile. The profiles can thus be readily assembled and held together without having to use any tools or additional components.

In one embodiment, the first and second profile are configured to be interconnected solely by means of the connection element. The connection element thus not only serves as the anchor point from which the grid profiles are supported, but also as the interconnecting means which holds the profiles together. The assembly of the grid profiles is simplified as the profiles does not have to be assembled beforehand.

The first and second profile may, in the loaded and installed condition, be configured to be deflected such that they obtain an essentially linear extension. By application of a load on the grid of profiles, the upwardly bulging first and second profile will thus be straightened out by a controlled deflection and obtain an essentially linear extension. Deviations from this essentially linear extension, i.e. an additional deflection, may be allowed in accordance with various standards, such as EN 13964.

The curved extension of the first and second profile may be such that the maximum controlled deflection of each profile in the loaded and installed condition is in the range of 5-20 mm.

In a second aspect, a method is provided for installing a suspended ceiling system comprising a plurality of ceiling tiles and a grid of profiles for supporting the plurality of ceiling tiles. The method comprises:

Providing a first and second profile each comprising two laterally extending flanges and an upstanding web provided with a bulb at its free end. Each of the first and second profile has a curved extension.

Interconnecting the first and second profile such that they extend along a longitudinal axis, the interconnecting comprising snap fit mounting of a connection element over a portion of the bulbs at a joint between the first and second profile.

Suspending the first and second profile by connecting a suspension element to the connection element such that the interconnected first and second profile, in an unloaded condition, each bulges in an upward direction.

The installation of the suspended ceiling system is thus faciliated, as the connection element not only serves to interconnect the first and second profile but also to suspend the profiles.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
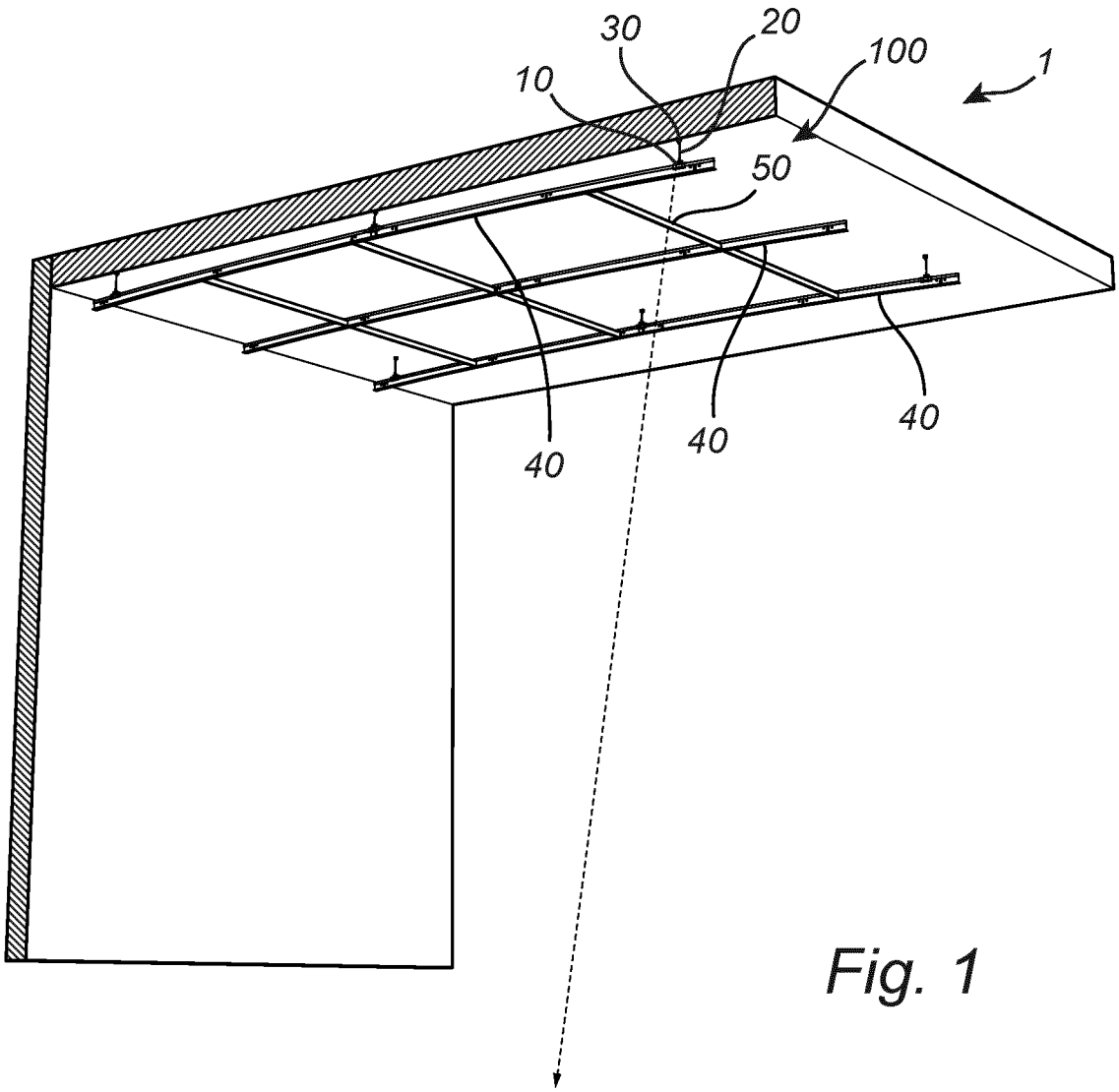
FIG. 1 discloses a perspective view of a suspended ceiling system.

In FIG. 1, a suspended ceiling system 1 is shown. The ceiling system 100 is intended to be suspended from the ceiling structure and is configured to carry ceiling tiles (not shown) and various equipment, such as lights, cables, ventilation ducts etc., depending on the application at hand. The ceiling system 1 comprises a grid 100 of profiles, the profiles being interconnected such that the grid 100 is formed. The system 1 may comprise profiles of two types; profiles 40 extending in a first direction and transverse profiles 50 extending in a direction perpendicular to the first direction.

The profiles 40 are suspended to the ceiling structure by means of a connection element 10 and a suspension element 20 which is fitted in each joint between two profiles 40. The suspension element 20 may be connected to a ceiling mount 30, which may take the shape of a bracket or an angle iron of some sort which allows attachment of the suspension element 20 thereto.

The transverse profiles 50 are, when used, supported by the profiles 40. The profiles 40, and optionally the transversal profiles 50, are arranged to form the grid 100 which has openings into which the ceiling tiles will fit.

The ceiling tiles generally functions to provide an appealing appearance to the suspended ceiling system 1, to dampen sound and to hide the ceiling structure and possible building equipment that is arranged above the suspended ceiling system 1. Such ceiling tiles may be formed in many different ways, the teachings herein are not limited to use with any particular type of ceiling tiles. However, in one embodiment, the ceiling tiles may be made of man-made mineral fibre, such as a compressed mineral fibre material. More specifically, the mineral fibre material may be mineral wool, especially glass wool. In addition to the mineral fibre material, the ceiling tiles may comprise a binder. The ceiling tiles may further comprise at least one surface layer.

As shown in FIG. 1, it is the profiles 40 which are suspended and that thus carries the weight of the tiles, of any possible transversal profiles 50 and of any eventual equipment fitted to the grid 100.

In order to increase the load carrying capacity of the profiles 40, they are provided with a curved extension and are configured to be installed such that they, in an installed and unloaded condition, bulges in an upward direction. The profiles 40 are also configured such that they in a loaded and installed condition, i.e. in response to a load, such as ceiling tiles, being applied to the profiles, are deflected such to obtain an essentially linear extension. The curved extension of the profiles 40 may be such that the maximum deflection of each profile 40 in the loaded and installed condition is in the range of 5-20 mm, whereby the profiles obtain the essentially linear extension.

The upwardly curved extension of the profiles will allow greater load to be placed on each profile 40 before it exceeds a certain regulated value for the downward deflection from the essentially linear extension. The deflection value may for example be defined depending on the distance L between the suspension points, for example measured in mm, divided by a factor of 300. I.e. a maximum allowed deflection could be defined as f=L/300. However, according to EN13964 class 3, the maximum deflection allowed is 4 mm, regardless of the distance between the suspension points.

The profiles 40 are configured to be interconnected such that a first and second profile of said profiles 40 can be attached to each other end to end along the longitudinal axis of the profiles 40. In one embodiment, the connection element 10 is configured to solely interconnect the first and second profile 40. The connection element 10 can thereby serve two purposes in that it not only provides an anchor point from in the joint from which the grid 100 can be suspended, but in that it also structurally connects each adjacent profile 40 in the grid 100.

Arranging the connection elements 10 in the joints between the profiles 40 is also beneficial in that is reduces the amount suspension elements 20 required for suspending the ceiling system 1. This saves time when installing the system 1, facilitates the installation process and reduces cost of material.

Further, the reduced amount of suspension elements 20 also reduces the risk of clashing, i.e. that an installation or building structure in the area of the ceiling structure interferes with the desired position of a suspension element.

Figure 2:
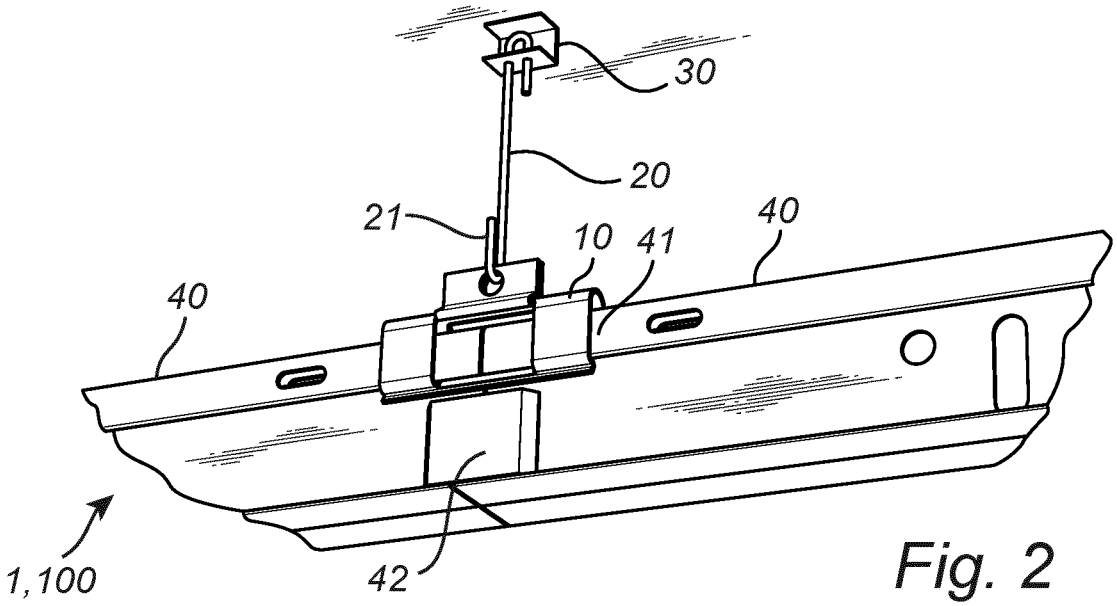
FIG. 2 discloses a close up perspective view of a joint between two profiles of said ceiling system.

In one embodiment, as shown in FIG. 2, each of the first and second profile 40 has a joint end provided with a tongue arrangement 42, the tongue arrangements 42 of the first and second profile 40 are configured for interlocking engagement in the interconnected state of the first and second profile 40. The profiles 40 may thus be held together by the interaction of the tongue arrangement 42 on each profile 40. In this embodiment, the connection element 10 may not necessarily contribute in any greater extend to the connection of the first and second profile 40, but primarily provides an anchor point for connecting the suspension element 20. However, the connection element 10 may be configured provide a more substantial connection effect in addition to or instead of the interlocking effect of tongue arrangements 42 of the profiles 40.

Each profile 40 is connected to at least two connection elements 10. For prior art solutions, this means that each profile 40 is suspended by components corresponding to two suspension elements and two connection elements. In the context of the present disclosure, every two adjacent profiles 40 shares a connection element 10 and a suspension element 20. This reduces the number of connection elements 10 and suspension elements 20 necessary. Further still, in the context of grid systems with profiles 40 which are curved as explained above, the connection element 10 aligns the ends of two adjacent profiles 40 in the joint between the profiles 40. It also allows usage of the curvature of the profiles 40 over the entire length of the profiles 40, as they are suspended in the ends of the profiles 40.

FIG. 2 shows the system 1 in FIG. 1 in a close up view where a connection element 10, a thereto connected suspension element 20 and an optional ceiling mount 30 are shown. The suspension element 20 is shown comprising an optional hook member 21. The hook member 21 is in one embodiment configured to interact with an opening 15 of a protruding section 14 of the connection element 10, which is shown in detail in FIG. 3. The opening is configured to receive the hook member 21 for connection of the suspension element 20 to the connection element 10.

It is also shown in FIG. 2 how the connection element 10 is mounted in a snap fit manner over a portion of the bulbs 41 which are arranged on the profiles 40. The interaction of the connection element 10 and the bulb 41 on the respective adjacent first and second profile 40 securely holds the profiles 40 in place. It should be noted however, that other means for mounting the connection element over the bulbs other than by snap fit mounting is conceivable.

Figure 3:
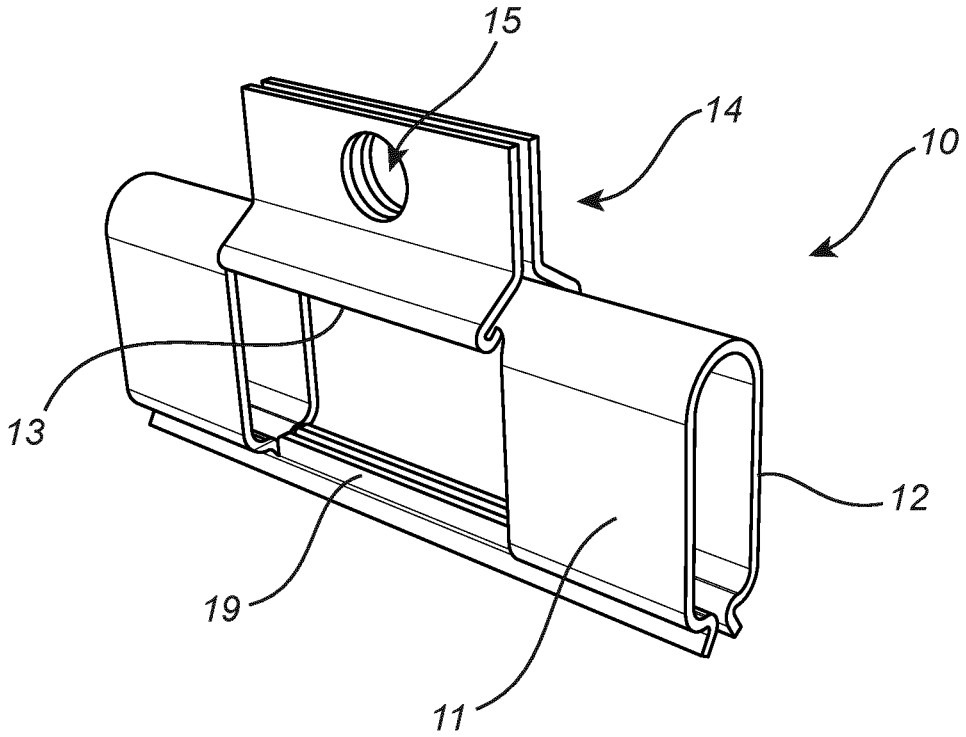
FIG. 3 discloses a perspective view of a connection element.

Turning to FIG. 3, which discloses a detail view of the connection element 10 according to one embodiment. The connection element 10 in the embodiment shown, comprises two resilient legs 11, 12 which for the snap fit mounting are configured to straddle and retain the portion of the bulbs 41 of first and second profile 40. The connection element 10 can thus be mounted simply by pressing the connection element 10 onto the first and second profile 40, the interaction between the legs 11, 12 and the bulbs 41 will securely support the first and second profile 40.

Figure 5:
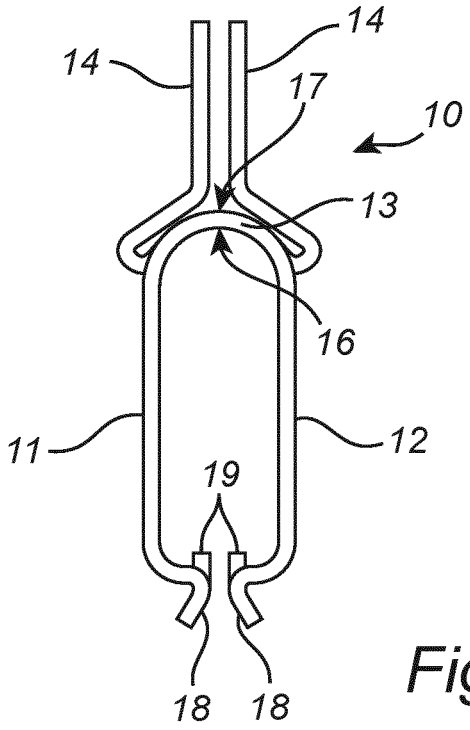
FIG. 5 discloses a side view of a connection element.

As can be further seen in FIG. 3, the connection element 10 may comprise a bridging section 13. The bridging section 13 has a first side 16, as can be seen in FIG. 5, from which the two resilient legs 11, 12 may extend. The optional protruding section 14 which is provided with the opening 15 is arranged on a second side 17 of the bridging section 13, which can also be seen in FIG. 5. The second side 17 is opposite the first side 16.

Figure 4:
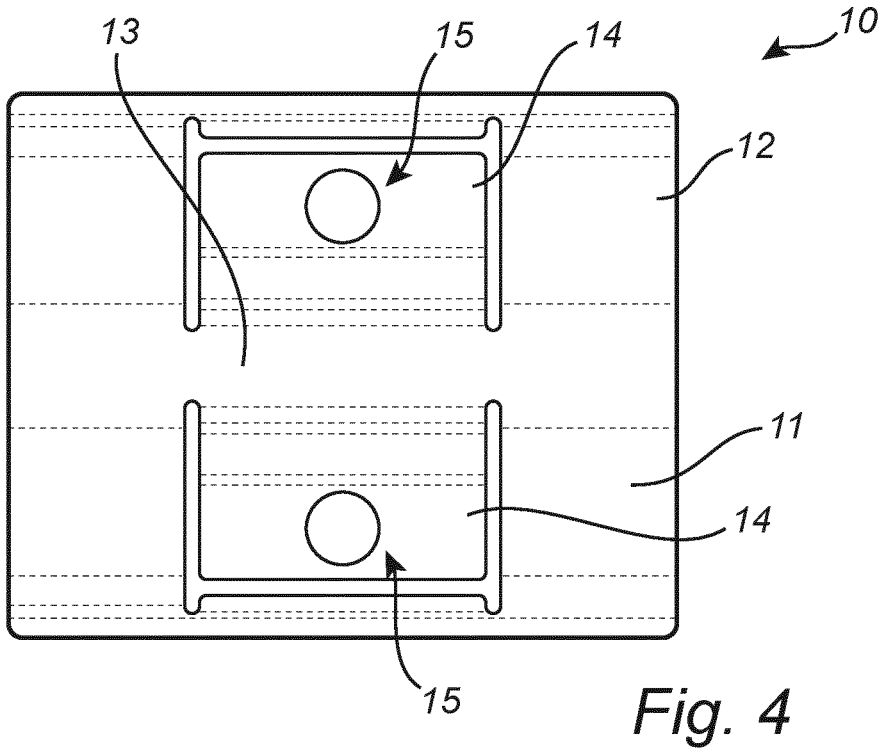
FIG. 4 discloses a plan view of a connection element before folding into final shape.

What is further evident from FIGS. 3 and 4 is that the connection element 10 may be manufactured from sheet metal by means of punching and bending. Manufacturing the connection element 10 out of sheet metal provides benefits in terms of providing the desired resiliency in the material for the legs 11, 12 to be able to flex as necessary for the snap fit mounting to the profile 40. It is also preferred that the connection element 10 is manufactured out of metal, such as stainless steel or galvanized steel, as it must be able to sufficiently well withstand the heat during a potential fire. However, other materials are also considered depending on the application. The connection element 10 could be manufactured from a polymeric material, or from a composite material such as e.g. carbon composite.

FIG. 4 shows the connection element 10 blank material after punching but before bending into its final shape. As shown, the protruding section 14 may comprise two cut-out portions which are bent to form the protruding section 14, such that the openings 15 in the respective portion are aligned when the connection element 10 is finalized.

FIG. 5 shows the connection element 10 from the side. The opposite first and second side 16, 17 of the bridging section 13 is shown being formed by the middle portion of the connection element 10. The free end of each leg 11, 12 may comprise a lip section 18. Each lip sections 18 is bent such that it extends at an incline away from the lip section 18 on the opposite leg 11, 12. A wedge shaped recess is thus formed between the two lip sections 18 which facilitates mounting of the connection element 10 over the bulb 41 of the profile 40 such that the legs 11, 12 straddle the bulb 41 in a snap fit manner.

What is further shown in FIGS. 4 and 5 is that the connection element 10 may comprise locking members 19 which protrude from the free end of each leg 11, 12. The locking members 19 protrude towards the bridging section 13 such that the may form a securing engagement against the bulb 41. In one embodiment shown in FIG. 6, the bulb 41 of each profile 40 comprises a recess or groove 45 into which the locking member 19 will be arranged when the connection element 10 is fitted to the profile 40. The interaction between the locking member 19 and the groove 45 will prevent that the legs 11, 12 of the connection element 10 for some reason unintentionally to be released from the bulb 41.

Figure 6:
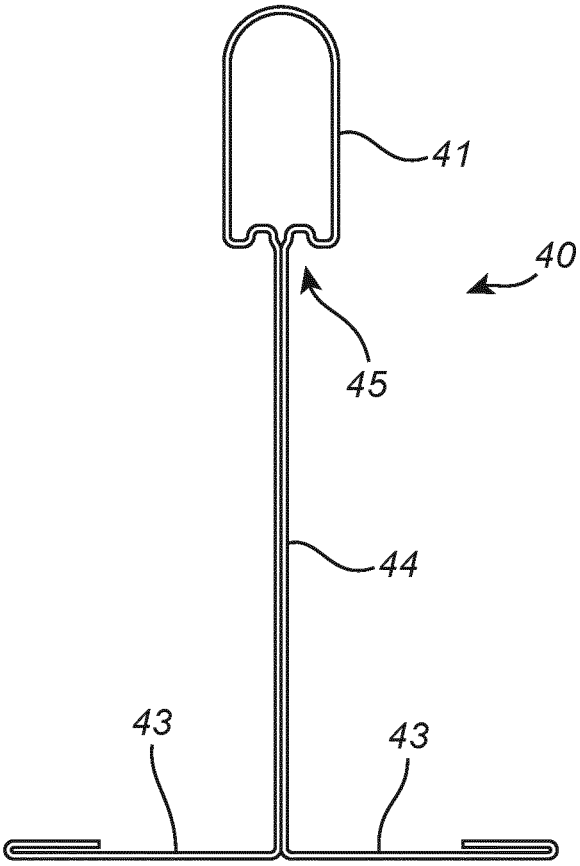
FIG. 6 discloses a view along the longitudinal axis of a grid profile.

In FIG. 6 it is further shown that each profile 40 comprises two laterally extending flanges 43 and an upstanding web 44 which is provided with the bulb 41 at its free end. The profile is preferably made in a roll forming operation out of a sheet blank of metal, for example steel. The sheet blank is fed between successive pairs of rolls that progressively bend, fold and form the sheet blank until the desired shape and cross section of the profile 40 is obtained. A beneficial profile and method for manufacturing the profile can be found in EP 2 562 323 A1. The teachings herein are however not limited to use with profiles being manufactured in any specific way or of any specific material, any profile having the essential features outlined in claim 1 will be suitable for use with the suspended ceiling system 1.

Figure 7:
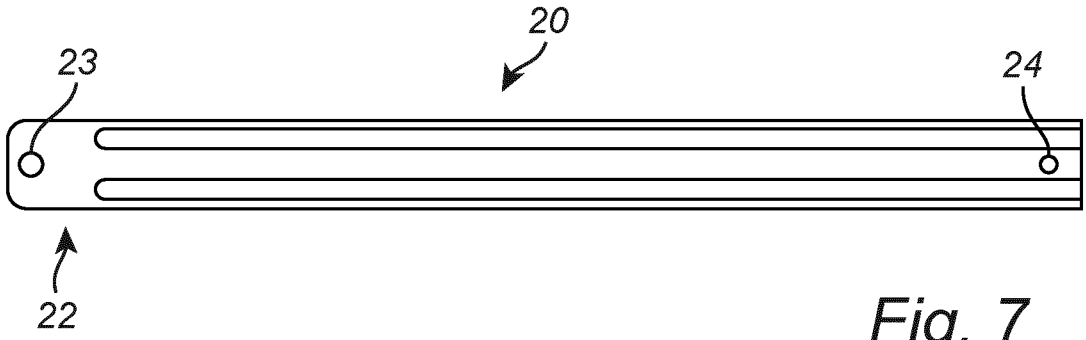
FIG. 7 discloses a plan view of a suspension element.

Turning now to FIG. 7 which shows a suspension element 20 according to one embodiment. In FIG. 7, the suspension element 20 is embodied as a strip of sheet material, preferably out of metal such as steel but other materials are also considered. The suspension element may comprise reinforcing ribs along the length of the element 20. The suspension element 20 may further comprise a free end 22 which is provided with an opening 23. The suspension element 20 is connectable to the connection element 10 by means of a fastener inserted into the openings 23, 15 of the suspension element 20 and the protruding section 14 when the openings 23, 15 are aligned with each other.

In the embodiment where the protruding section 14 is formed by two cut-out portions, the free end 22 of the suspension element 20 could be configured to be arranged between the two portions of the protruding section 14 and then fastened with the fastener.

Alternatively, as mentioned above, the suspension element 20 may comprise a hook member 21 configured to cooperate with the opening 15 in the protruding section 14.

The suspension element 20 may further be provided with an additional opening 24 on the end opposite the free end 22. The additional opening 24 being configured to be attached to the ceiling mount 30 by means of a suitable fastener.

Figure 8:
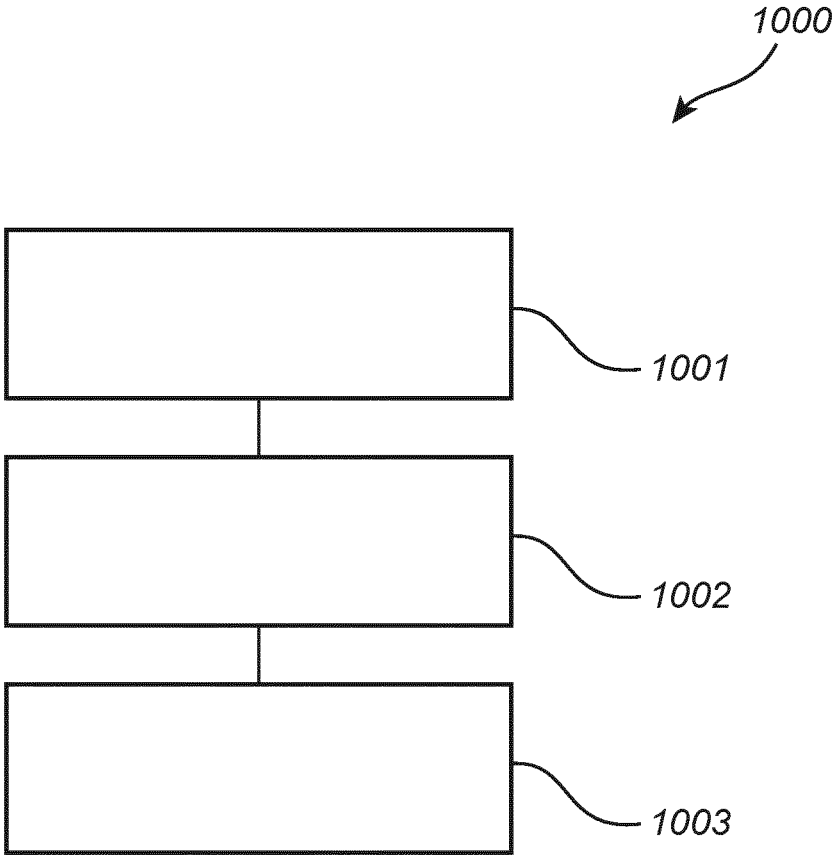
FIG. 8 discloses a schematic outline of a method for installing a suspended ceiling system.

FIG. 8 shows a schematic outline of a method for installing a suspended ceiling system 1 as described above. The method comprises providing 1001 a first and second profile 40 each comprising two laterally extending flanges 43 and an upstanding web 44 provided with a bulb 41 at its free end. Each of the first and second profile 40 has a curved extension. The profile, as mentioned, does not need to be made from any particular material or by any particular process. The first and second profiles 40 are then interconnected 1002 such that they extend along a longitudinal axis. The interconnecting comprising snap fit mounting of a connection element 10 over a portion of the bulbs 41 at a joint between the first and second profile 40.

The first and second profiles 40 are then suspended 1003 by connecting a suspension element 20 to the connection element 10 such that the interconnected first and second profile 40, in an unloaded condition, each bulges in an upward direction.

It will be appreciated that the present invention is not limited to the embodiments shown.

The connection element may be formed in different ways. For instance, the protruding section need not be formed from bent cut-out portions but may constitute a top portion of a folded sheet metal material, wherein the two legs extend continuously form the top portion.

Several modifications and variations are thus conceivable within the scope of the invention which thus is exclusively defined by the appended claims.

The invention claimed is:

1. A suspended ceiling system comprising:

a plurality of ceiling tiles; and a grid of profiles for supporting the plurality of ceiling tiles, the grid of profiles including at least a first profile and a second profile configured to be interconnected along a longitudinal axis, the first and second profiles each comprising two laterally extending flanges and an upstanding web provided with a bulb at a free end of the upstanding web, wherein each of the first and second profiles has a curved extension and is configured to be installed such that each of the first and second profiles, in an installed and unloaded condition, bulges in an upward direction, wherein the suspended ceiling system further comprises a connection element arranged for mounting over a portion of the bulbs of the first and second profiles at a joint between the first and second profiles, and wherein a suspension element is connectable to the connection element for suspension of the first and second profiles in an interconnected state.

2. The suspended ceiling system according to claim 1, wherein the connection element is arranged for snap fit mounting over the portion of the bulbs of the first and second profiles.

3. The suspended ceiling system according to claim 2, wherein the connection element comprises two resilient legs which for said snap fit mounting are configured to straddle and retain the portion of the bulbs of first and second profiles.

4. The suspended ceiling system according to claim 3, in which the connection element comprises a bridging section having a first side from which the two resilient legs extend; and a protruding section provided with an opening arranged on a second side, opposing the first side, of the bridging section, wherein the suspension element is configured to connect to the connection element by means of said opening.

5. The suspended ceiling system according to claim 1, wherein the connection element comprises a protruding section provided with an opening and wherein the suspension element is configured to connect to the connection element by means of said opening.

6. The suspended ceiling system according to claim 5, in which the suspension element comprises a hook member, wherein the opening of the protruding section is configured to receive the hook member for connection of the suspension element to the connection element.

7. The suspended ceiling system according to claim 5, in which the suspension element comprises a free end provided with an opening, wherein the suspension element is connectable to the connection element by means of a fastener inserted into the opening of the suspension element and the opening of the protruding section when the openings are aligned with each other.

8. The suspended ceiling system according to claim 1, wherein the connection element is made of a sheet metal material.

9. The suspended ceiling system according to claim 1, wherein each of the first and second profiles has a joint end provided with a tongue arrangement, wherein the tongue arrangements of the first and second profiles are configured for interlocking engagement in the interconnected state of the first and second profiles.

10. The suspended ceiling system according to claim 1, wherein the first and second profiles are configured to be interconnected solely by means of the connection element.

11. The suspended ceiling system according to claim 1, wherein the first and second profiles, in a loaded and installed condition, are configured to be deflected such that they obtain an essentially linear extension.

12. The suspended ceiling system according to claim 11, wherein the curved extension of the first and second profiles is such that the maximum deflection of each profile in the loaded and installed condition is in a range of 5-20 mm.

13. A method for installing a suspended ceiling system comprising a plurality of ceiling tiles and a grid of profiles for supporting the plurality of ceiling tiles, the method comprising:

providing a first profile and a second profile each comprising two laterally extending flanges and an upstanding web provided with a bulb at a free end of the upstanding web, wherein each of the first and second profiles has a curved extension, interconnecting the first and second profiles such that they extend along a longitudinal axis, said interconnecting comprising mounting of a connection element over a portion of the bulbs at a joint between the first and second profiles, and suspending the first and second profiles by connecting a suspension element to the connection element such that the interconnected first and second profiles, in an unloaded condition, each bulges in an upward direction.

* * * * *